United States Patent [19]

Arnold

[11] Patent Number: 4,635,865

[45] Date of Patent: Jan. 13, 1987

[54] APPARATUS AND PROCESS FOR WINDING ELECTRICAL COILS

[75] Inventor: Ernst Arnold, Buchs, Switzerland

[73] Assignee: Meteor AG, Ruschlikon, Switzerland

[21] Appl. No.: 641,947

[22] PCT Filed: Nov. 28, 1983

[86] PCT No.: PCT/CH83/00133

§ 371 Date: Aug. 3, 1984

§ 102(e) Date: Aug. 3, 1984

[87] PCT Pub. No.: WO84/02225

PCT Pub. Date: Jun. 7, 1984

[30] Foreign Application Priority Data

Dec. 3, 1982 [CH] Switzerland ..... 7034/82

[51] Int. Cl.[4] ..... H01F 41/10

[52] U.S. Cl. ..... 242/7.03; 29/605; 242/7.09; 242/7.11; 242/7.14

[58] Field of Search ..... 242/7.09, 7.11, 7.14, 242/7.03; 29/605; 140/91.1, 91.2

[56] References Cited

U.S. PATENT DOCUMENTS

| | | | |
|---|---|---|---|
| 3,101,180 | 8/1963 | Sadorf | 242/7.11 |
| 3,314,452 | 4/1967 | Cartwright | 242/7.09 |
| 3,409,980 | 11/1968 | Lawless et al. | 242/7.09 |
| 4,157,165 | 6/1979 | Bierman | 242/7.14 |

FOREIGN PATENT DOCUMENTS

| | | | |
|---|---|---|---|
| 1941928 | 4/1971 | Fed. Rep. of Germany . | |
| 2632671 | 1/1978 | Fed. Rep. of Germany | 242/7.09 |
| 2090172 | 7/1982 | United Kingdom . | |

OTHER PUBLICATIONS

Brochure, Pneumatic Three-Position Rotating Drive--Type Z 5151 by Omni Ray AG, Industriestrasse 31, CH 8305, Dietlikon, Switzerland.

European Patent Application No. 0,003,647, published Aug. 22, 1979.

*Primary Examiner*—Billy S. Taylor

*Attorney, Agent, or Firm*—Burns, Doane, Swecker & Mathis

[57] ABSTRACT

To improve the twisting of wire ends on a coil form having contact pins axially located with respect to a winding shaft, a swivel shaft is provided on each coil holder of a coiler tool. One end of the swivel shaft is in the form of a driving pin and the other in the shape of a fork. The fork shaped end of the swivel shaft is capable of engaging a driving pin located on a rotating drive shaft. The coil holder is in the form of a strap and tiltable. The wire ends are cut by a wire cutting device that is displaceable vertically with respect to a wire guide. The contact pins with the wire ends twisted on them in a parallel manner may serve simultaneously as plug-in pins for printed circuits.

2 Claims, 7 Drawing Figures

APPARATUS AND PROCESS FOR WINDING ELECTRICAL COILS

Figure 1:
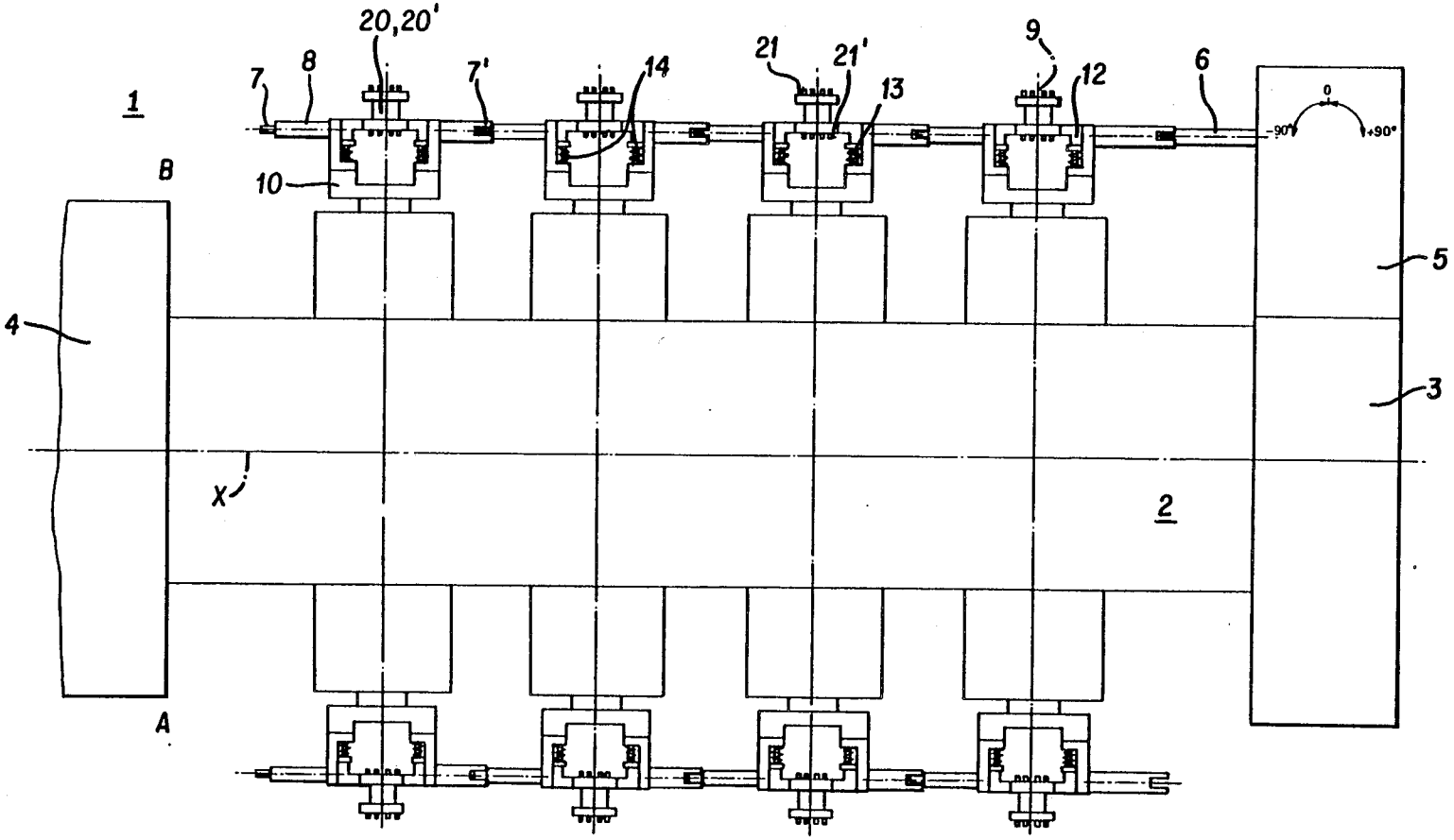
Figure 2:
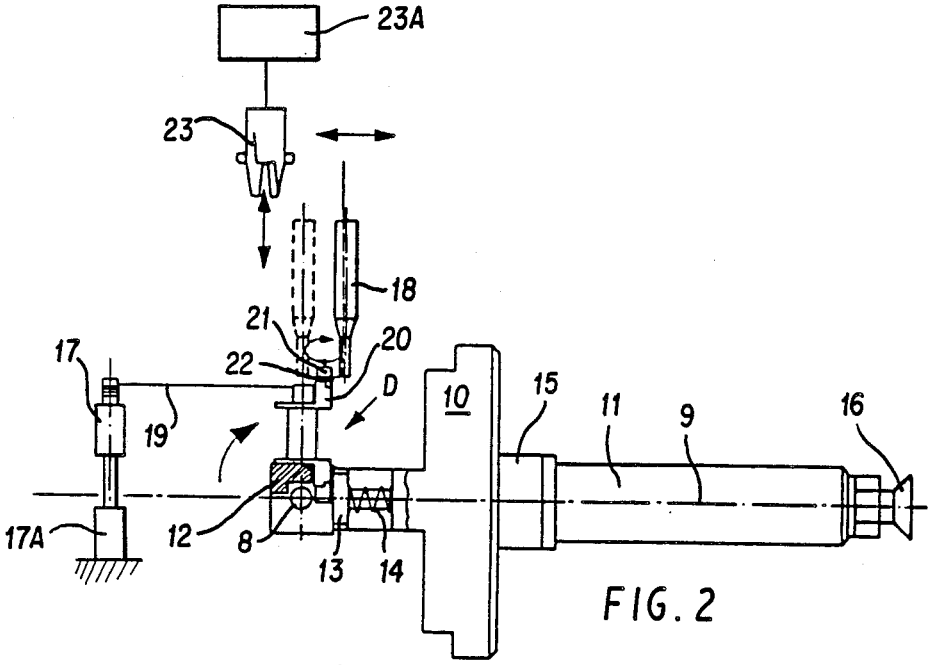
Figure 2A:
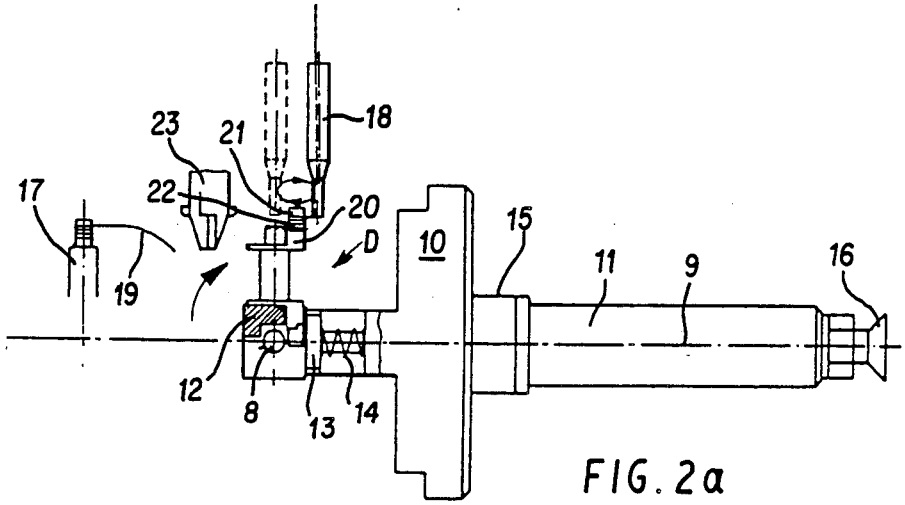

The invention relates to a process for and apparatus twisting of wire ends onto contact pins of coils.

In the winding of electric coils, for example on a multiple coiler machine, it is customary to twist the contact pins arranged axially with respect to the coil axis on the flange sides of a coil form, by means of again axially arranged wire guides. The wire ends on the outer contact pins of the free-standing flange side of the coil receiver arranged perpendicularly to the support may be twisted on by the wire guide arranged axially to it. In contrast, the wire ends may be twisted onto the inner contact pins facing the coil receiver to a limited extent only, i.e. without an additional effort, as the wire guide must be pivoted for twisting onto the inner contact pins, for which the contact pins must be sufficiently long. Furthermore, the wire cutting devices located stationarily in the cutting area may frequently interfere with the winding process.

As the wire guide cannot be arranged perpendicularly with respect to the contact pins, satisfactory parallel twisting as required for printed circuits is not possible. In the case of coils of this type, which are intended to be inserted in printed circuits, separate plug-in pins must therefore be provided.

It is the object of the present invention to provide a coiler machine layout making it possible to twist wire ends onto contact pins located axially with respect to the coil axis satisfactorily, preferably in layers and without interference, and to cut them so that the contact pins may be used simultaneously as plug-in pins in printed circuits.

The advantage of the invention consists, in particular, in having the wire ends of electric coils twisted parallel onto the contact pins located on both flange sides of the coil form axially with respect to the coil axis, so that the contact pins may be used as plug-in contacts in printed circuits, following soldering by a process known in itself.

A further advantage is that the wire guides are conducted perpendicularly to the coil axis both for the winding of the coil form itself and for the twisting of the wire ends, thereby simplifying the control of the wire guides. The wire cutting devices which may be moved in and out of the winding area both vertically and horizontally, provide a better utilization of the available space and thus an operation without interference.

These objects and advantages will become more apparent from an example of the preferred embodiment.

Figure 3:
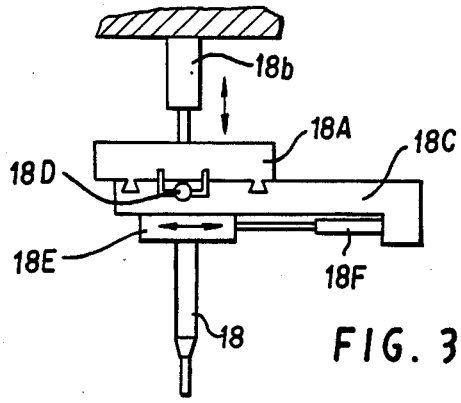
Figure 2B:
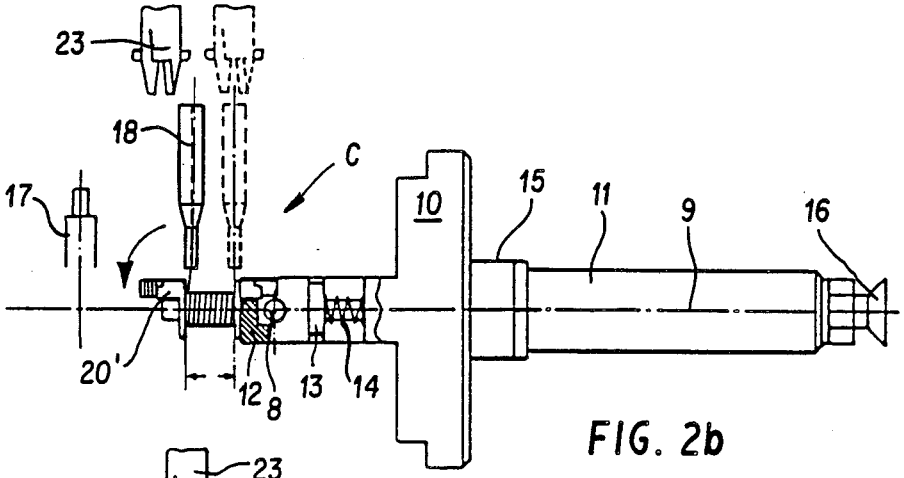
Figure 2C:
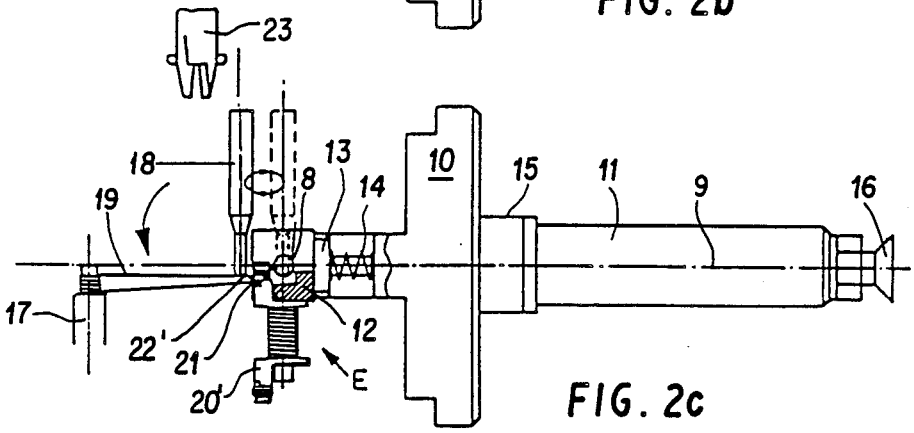
Figure 2D:
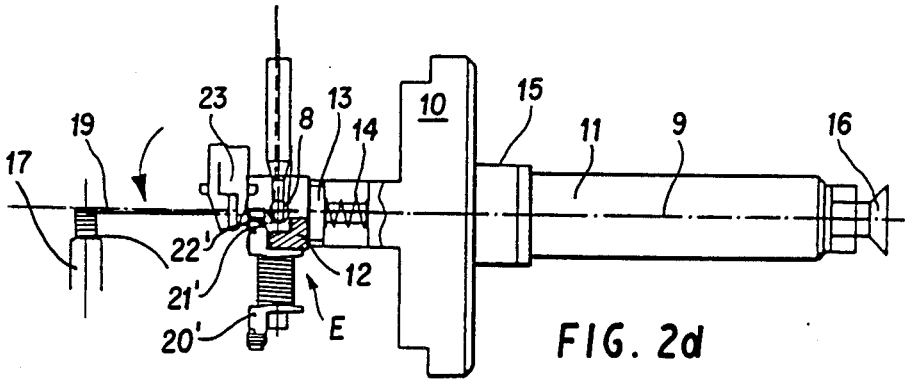

In the drawings:

FIG. 1 shows a schematic layout of a multiple coiler machine with coil forms set in coil holders;

FIGS. 2, 2*a*, 2*b*, 2*c* and 2*d* are partially sectioned lateral elevations of a coiler tool according to FIG. 1 in different working position; and FIG. 3 is a schematic side elevational view of a mechanism for shifting the wire guide.

FIG. 1 shows an automatic multiple coiler 1 known in itself, laid out for example with four coiler tools 10 on each longitudinal side, wherein in a support 2 the coiler tools 10 are arranged facing each other so that always one coiler tool 10 is located on another feeder side A and the coiler tool 10 is located 180° opposite on the production side B. By means of a pivot drive 4 known in itself, the coiler tools 10 are pivoted in the support 2 around the axis X from the feeder side A to the production side B. The drive for the coiler tools 10 may be provided for example by a dc motor (not shown).

Each coiler tool 10 has a coil holder 12 in the form of a shackle and provided with a swivel shaft 8. The individual swivel shafts 8 are designed as driving pins 7 on one end and in the shape of a fork 7' on the other end, so that the driving pins 7 may engage the fork shaped end 7' of the opposite coil holder 12 with clearance. By means of a rotating drive shaft 6, also equipped with a driving pin 7, of a conventional pneumatic three-position rotating drive 5 available from Omni Ray AG, Industriestrasse 31, CH-8305, Dietlikon, Switzerland, the swivel shafts 8 engaging each other may be brought into the corresponding working positions, together with the corresponding coil holders 12 and the coil forms 20, 20', as described in more detail in FIGS. 2, 2*a*, 2*b*, 2*c* and 2*d*. For positioning in these working positions, on each coil holder 12 catches 13 with compression springs 14 are provided, with said catches optionally being of a mechanically locking type (not shown). The coil forms 20 with the contact pins 21, 21', for example prior to winding, are inserted in the initial position C in the coil holders 12 in a freely supported manner.

According to FIGS. 2, 2*a*, 2*b*, 2*c* and 2*d*, each coiler tool 10 has a receiver shaft 11 with positioning surfaces 15 and a distance stop 16. Each coil holder 12 with the coil forms 20, 20' is pivotable around the pivot shaft 8 and may be held in the different working positions, i.e. the initial position C (FIG. 2*b*) corresponding to the winding position, a wire start twisting position D (FIG. 2) and a wire end twisting position E (FIG. 2*c*), by way of catches 13 secured by compression springs 14.

On each of the coiler tools 10 located on the production side B, a pivoting wire guide 18 is provided, which in the winding position is arranged vertically with respect to the coil axis 9, while the coil wire 19 is being held additionally by a holder pin 17 arranged outside the coiler tool 10. The holder pin can be raised and lowered by a conventional motor 17A. The winding and twisting of the coil forms 20, 20' and the contact pins 21, 21' by the wire guide 18 is always effected by a coil wire 19 guided perpendicularly to the coil form, so that the contact pins 21, 21' may be wound and twisted in parallel windings. A mechanism for moving the wire guide is depicted in FIG. 3 and operates under the conventional action of separately moveable frames. In that regard, a first frame 18A is vertically moveable by means of a motor 18B. A second frame 18C is mounted on the first frame for sliding movement in one horizontal direction (i.e., a direction perpendicular to the paper) and is moved in that direction by a motor 18D carried by the first frame 18A. A third frame 18E is mounted on the second frame 18C for sliding movement in a second horizontal direction perpendicular to the direction of movement of the second frame 18C. Movement of the third frame is effected by a motor 18F carried by the second frame 18C. The wire guide 18 is carried by the third frame 18E. The wire cutting devices 23, which, for example, may be displaced vertically, are moved out of the winding area after the cutting of the wire, so that operation without interference is assured. While the wire guide 18 actuated by means of a mechanism 23A including stepping motors in a manner known in itself always retains its vertical position, the coil form 20, 20' is always tilted by 90°, together with the contact pins 21, 21'.

The mode of operation of the layout according to the invention is as follows:

The four unwound coil forms 20 inserted in the coil holders 12 have already been pivoted (FIG. 1) from the feeder side A to the production side B by 180° and are in their initial position C. By the rotation of the drive shaft 6 in a counter clockwise direction, the swivel shafts 8 connected with each other in an articulated manner, are tilted with the coil forms 20 inserted in the coil holders 12, from their initial position C by 90°, i.e. upwardly according to FIG. 2, into the wire start twisting position D. By means of each wire guide 18, the start 22 of the wire is twisted onto the outer contact pin 21 of the coil form 12 projecting from the coilholder 12, in layers. Subsequently, the wire cutting device 23 is moved vertically into the cutting area and the wire start 22 cut (FIG. 2*a*), while the winding wire 19 is being transported from the contact pin 21 to the coil for winding.

After the wire starts 22 have been twisted onto the outer contact pins 21, the coil holders 12 are tilted back together with the coil forms 20 by the rotation of the drive shaft 6 (FIG. 1) in the clockwise direction into their initial position C in the direction of the arrow (FIG. 2*b*) by 90° and the coil form 20 is wound by the wire guide 18 in the axial direction of the coil, whereby winding by layers is commenced at the side of the flange facing away from the coiler tool 10 and terminated on the side of the flange facing the coiler tool 10.

During the winding of the coil form 20, 20', the driver pins 7 are not engaging the fork like ends 7' of the swivel shafts 8, but the swivel shafts 8 are rotating always around the winding shaft 9, with the driving pins 7 sliding through the fork shaped ends 7', as at the onset of the rotating motion the fork like ends 7' are aligned in an exact horizontal manner.

Subsequently, by the rotation of the rotating drive shaft 6 in the clockwise direction, by means of the driving pins 7 engaging the fork shaped ends 7' of the swivel shaft 8 the coil holders 12 with the wound coil form 20' are tilted from the initial position C again by 90° in the direction of the arrow, (FIG. 2*c*), into the wire end twisting position E. By means of the wire guide 18, the wire end 22' is twisted onto the inner contact pin 21' of the coil form 20' located inside the coil holder 12 and the winding wire 19 fastened to a holding pin 17 arranged outside the coiler tool 10, whereupon (FIG. 2*d*) the end of the winding 19 is cut at the contact pin 21'.

The twisting of the wire ends 22, 22' is effected in layers, wherein the actuation of the wire guide 18 may be controlled in the manner desired by means of stepping motors.

By the rotation of the rotating drive shaft 6 in the counter clockwise direction the coil holders 12 are tilted back into their initial position C with the finished coils and subsequently pivoted back from the production side B by 180° to the feeder side A.

The finished coils pivoted back to the feeder side A are removed manually or automatically from the coil holders 12 and the unwound coil forms 20 are inserted into the coil holders for the next working cycle.

The ready wound coil forms 20' with the wire ends twisted onto the contact pins 21, 21' may be usd after soldering in a known manner, advantageously as plug-in pins in printed circuits, without the need for providing separate plug-in pins.

The sequence of the twisting of the contact pins 21, 21' and the winding of the coil forms 20, 20' may be adapted to the prevailing requirements and must not necessarily follow the working cycles described above.

In the winding of coils with axially unilaterally outer contact pins 21, the twisting of the wire ends 22 onto the contact pins 21 may be effected in a known manner by tilting the wire guide 18 by 90°. In this case, horizontally displaceable cutting devices are provided.

What is claimed is:

1. A process for the twisting of wire ends onto contact pins of electrical coil forms on coiler machines, wherein each coil form has axially arranged inner and outer contact pins located on respective opposite sides thereof, and said coiler machine has at least one wire guide which cooperates with at least two coiler tools having coil holders and located at 180° on a rotatable support, and with a wire cutting device, which process includes the following steps:

(a) inserting an unwound coil form in the coil holder of a coiler tool, and rotating the support into an initial position, (b) providing the coiler tool with a swivel shaft one end of which has a fork shaped end and the other end has a driver pin, providing a rotating drive shaft having a driver pin for engaging the fork shaped end of the swivel shaft, whereby the rotation of the driveshaft in a first direction tilts the coil holder upwardly by 90° into a wire start twisting position, (c) tilting the coil upwardly to said wire start twisting position and using the wire guide to twist the wire end onto the outer contact pin protruding from the coil holder, (d) rotating the drive shaft 90° in a second direction to rotate the coil holder, coil form, and the wire end twisting onto the outer contact pin into its initial position, and winding the coil form by the wire guide in the axial direction of the coil, (e) rotating the drive shaft 90° in said second direction by means of the driving pins engaging the swivel shaft so that the coil holder with the wound coil form is rotated from the initial position downwardly into the wire end twisting position, and using the wire guide to twist a wire end onto the inner contact pin within the coil holder and cutting the end of the winding wire at the inner contact pin of the coil form, (f) rotating the drive shaft 90° in said first direction so that the coil holder, together with the finished coil, is rotated upwardly into its initial position and subsequently pivoting the support 180° to bring the finished coil from a production side to a feeder side thereof.

2. In an apparatus for twisting wire ends onto contact pins of electrical coil forms on a coiler machine, comprising a plurality of coil forms, each coil form having axially arranged inner and outer contact pins respectively located on opposite sides thereof, at least two coiler tools having coil holders located at 180° on a rotatable support, at least one wire guide for cooperating with said at least two coiler tools having coil holders;

(a) a swivel shaft connected to the coil holder on each coiler tool, said swivel shaft having one end in the shape of a fork, and the other end in the shape of a driving pin, the forked end and driving pin end having complementary configurations so as to be capable of driving engagement with each other, (b) a rotating shaft having a driving pin fitting into the fork shaped end of the swivel shaft for driving engagement, and (c) catches and a compression spring for biasing said catches into engagement with said coil holder for releasably retaining said coil holder in one of three positions.

* * * * *